US005921131A

United States Patent [19]

Stange

[11] Patent Number: 5,921,131

[45] Date of Patent: Jul. 13, 1999

[54] METHOD FOR FRICTIONALLY GUIDING AND FORMING FERROUS METAL

[75] Inventor: Terry G. Stange, Waconia, Minn.

[73] Assignee: Hutchinson Technology Incorporated, Hutchinson, Minn.

[21] Appl. No.: 08/884,534

[22] Filed: Jun. 27, 1997

Related U.S. Application Data

[ 60] Provisional application No. 60/020,854, Jun. 28, 1996.

[51] Int. Cl.[6] ..... B21D 11/00

[52] U.S. Cl. ..... 72/379.2; 72/462

[58] Field of Search ..... 72/379.2, 342.3, 72/462, 467

[56] References Cited

U.S. PATENT DOCUMENTS

| | | | |
|---|---|---|---|
| 4,502,313 | 3/1985 | Phalin et al. | 72/342.3 |
| 5,178,645 | 1/1993 | Nakamura et al. . | |
| 5,366,522 | 11/1994 | Nakamura et al. . | |
| 5,571,236 | 11/1996 | Takahashi et al. | 72/467 |
| 5,673,730 | 10/1997 | Hamilton | 72/462 |

FOREIGN PATENT DOCUMENTS

| | | | |
|---|---|---|---|
| 64-62468 | 3/1989 | Japan | 72/462 |

OTHER PUBLICATIONS

Tribology in Metalworking: Friction, Lubrication and Wear, by John A. Schey, pp. 112, 384, 616 (1983).

Thin–Film–Diamond Derby by Phillip Craig, Senior Editor, Cutting Tool Energy, Feb. 1992, pp. 23–24.

Ultrahard Tool Materials by J.R. Davis, ASM Speciality Handbook, p.93 (1995).

*Primary Examiner*—Lowell A. Larson

*Attorney, Agent, or Firm*—Faegre & Benson LLP

[57] ABSTRACT

The present invention is a method for frictionally guiding and forming ferrous metal using a tool having a polycrystalline diamond ("PCD") surface in such a manner so as to limit graphitization, dissolution, and diffusion of the PCD surface caused by the ferrous metal. A tool having a PCD surface, such as a rail punch used to form stainless steel rail wipers in head suspensions, a dimple punch socket used to form dimples in head suspensions, or a frictional guide surface used to engage and mount base plates to head suspension load beams, engages and is frictionally moved relative to an object of ferrous metal. In some applications, the tool is further used to plastically deform the ferrous metal. This engagement, movement, and deformation occurs under conditions which limit asperity and surface temperatures of the PCD surface and the ferrous metal to about 50 degrees Celsius and about 700 degrees Celsius, respectively. This is accomplished by minimizing the force required to form the metal, and by limiting the speed at which the formation occurs.

8 Claims, 7 Drawing Sheets

METHOD FOR FRICTIONALLY GUIDING AND FORMING FERROUS METAL

This application claims the benefit of U.S. Provisional Application No. 60/020,854 filed Jun. 28, 1996.

TECHNICAL FIELD

The present invention relates to the field of frictionally guiding and forming ferrous metals, such as stainless steel, with tooling provided with a polycrystalline diamond surface.

BACKGROUND OF THE INVENTION

The use of tools to form and machine ferrous metals, such as stainless steel, is well known in various industries. One industry, for example, to which the present invention applies, is the manufacture of head suspensions for rigid disk drives from stainless steel sheet material as are used within the data storage industry. In such an application, tooling is typically used to cut, shape, and form the various components of a head suspension, including a base plate, a load beam, longitudinal rails along the load beam, a flexure, and a dimple in either the load beam or the flexure used as a load point during operation of the head suspension. To form stiffening rails along the side of a load beam, a rail punch having a rounded surface is used to form the longitudinal rails of the load beam by engaging and plastically deforming the edges of the material of the load beam. Similarly, a dimple forming punch can be used to engage a flat region of the load beam or the flexure to deform a "load point" dimple from the material thereof. Traditionally, tools such as a rail punch, a dimple punch and dimple socket incorporate tool steel or tungsten carbide cermet on wear surfaces to engage and form the ferrous stainless steel.

The use of tools to engage and frictionally guide ferrous metals such as stainless steel is also well known in various industries, including the manufacture of head suspensions. In such an application, a guide tool engages and moves a piece of ferrous metal over a surface. Friction between the ferrous metal and the guide surface over which it is moved generates heat and abrades the surface of the ferrous metal and/or the surface of the guide tool. For example, a pin in a base plate guide can be used to engage and guide a suspension base plate over an inclined surface and into alignment with a suspension load beam for attachment of the base plate to the load beam. As with tools used in forming operations of ferrous metal, the wear surfaces of guide tools over which ferrous material are frictionally moved traditionally incorporate tool steel or tungsten carbide into the guide surface.

The use of tools having a polycrystalline diamond (PCD) surface to machine or form non-ferrous materials is also well known in various industries. For example, PCD tooling is currently used in the machining and forming of aluminum, copper, brass, plastics, granite, fiber plastics such as Kevlar, wood and wood-based products, ceramics, and carbide. PCD is known for superior performance characteristics, and tools with a PCD surface often have a useful life that is 50 to 200 times greater than tools having tool steel or tungsten carbide cermet surfaces. Tools having PCD surfaces are thus desirable for repetitive operations such as cutting, turning, forming and milling. In addition, PCD exhibits a lower coefficient of friction against most materials than does tool steel or tungsten carbide cermets, and transfer of workpiece material to PCD is limited because of the inherently low surface energy of PCD. Build-up of workpiece material on a tool surface over usage increases the surface roughness. PCD tools generally maintain a smoother surface than conventional tools during metal forming, thus creating a smoother finished surface on the workpiece. A smooth PCD surface also leads to lower friction against the workpiece material, thus reducing or eliminating the need for lubricants in the machinery or forming process.

It is also well known and conventionally accepted, however, that PCD tooling can only be efficiently used on non-ferrous materials. A primary disadvantage of PCD, and PCD tooling, is that diamond is generally incompatible with ferrous metals because carbon, the base element of diamond, is soluble in iron. In other words, PCD tooling cannot effectively be used to frictionally guide, machine, or form ferrous materials because diamond dissolves and diffuses into the material due to the iron content of the material. Additionally, at temperatures above about 700 degrees Celsius, iron catalyzes the transformation of PCD surfaces to graphite, also known as "graphitization," which subsequently creates problems. First, graphite is a soft form of carbon and wears very poorly. This leads to reduced tool life and introduces graphite particles into the machining or forming process as the tool surface wears. In addition, carbon readily diffuses into iron at a rate that increases with temperature. As such, the PCD surface soon becomes too rough for proper use, or the tool wears rapidly and is unable to meet specifications for geometry and performance after a very short period. Because the local surface temperatures of metal during forming and machining operations can easily exceed 700 degrees Celsius, PCD tools are not used to frictionally guide, form, or machine iron-based materials.

Attempts have been made to artificially cool ferrous materials below 700 degrees Celsius during machining operations, thus allowing them to be machined using PCD tools. Researchers have attempted to use liquid nitrogen as a cooling agent when machining ferrous materials with PCD tools, thus reducing the high temperatures that cause graphitization and the PCD tool to dissolve and diffuse. However, the high cost of delivering and using liquid nitrogen as a cooling agent makes such a process economically unfeasible. The use of cooling agents also reduces the PCD tool's resistance to fracture, commonly known as the "fracture toughness." This is because cobalt is used as a binder for the PCD tooling, and at or near liquid nitrogen temperatures, the cobalt binder becomes increasingly brittle. As such, the fracture toughness of the PCD tool can be lowered by as much as 70%. In addition, the use of a cooling agent, or a lubricant of any sort, during machining or forming operations may introduce particles and/or other contaminants into the process, which is not desirable for precise operations. For these reasons, PCD tooling cannot generally be used to machine or form ferrous materials in an efficient manner, and cannot be effectively used in precise operations where contamination by a cooling agent is a concern.

SUMMARY OF THE INVENTION

The present invention is a method for frictionally guiding and forming ferrous materials, such as stainless steel, using tools having a PCD surface that overcomes the disadvantages associated with the prior art. One advantage of the present invention is that the useful life span of tools used to form ferrous metals can be increased by at least 10 times as compared to conventional tools having tool steel or tungsten carbide surfaces. A lower coefficient of friction against the ferrous metal and reduction of workpiece material transfer to the tool surface advantageously provide a smoother finished workpiece surface without having to polish or remove build-up from the tooling. Moreover, ferrous forming or guiding tools having a PCD surface have been found to become smoother with usage, and thus advantageously provide even smoother finished surfaces as time passes. Another advantage of the present invention is that the forming and guiding processes can be performed without the use of lubricants due to the decreased coefficient of friction between the tool and the ferrous metal.

The aforementioned advantages of the present invention can be achieved in a forming operation by providing a tool with a polycrystalline diamond surface, providing a sheet of ferrous metal, and engaging the PCD surface of the tool with the sheet of ferrous metal and advancing the tool so as to plastically deform the ferrous metal while controlling the advancing of the forming operations tool so that insufficient heat is generated by the deformation at the surface of the sheet of ferrous metal to cause significant degradation of the PCD surface by diffusion or graphitization. These advantages can also be achieved in a frictional guiding operation by providing a guide tool having a polycrystalline diamond surface, providing an object of ferrous metal, and guiding the ferrous metal object over the PCD surface of the guide tool so that insufficient heat is generated by the relative movement between the ferrous metal object and the PCD surface. Heat generation can be controlled in either operation in a number of ways. By controlling the sliding speed of the tool, a punch for example, against the ferrous material surface, heat generation can be limited. Likewise, decreasing the distance of sliding contact between the ferrous material and the tool surface generates less heat. Controlling acceleration on impact of the tool when initially contacting the ferrous material reduces the force generated and then provides less energy to be converted to heat. In addition, controlling the rate of the operations, that is, the cycle time to perform a forming or guiding operation on subsequent parts, can be utilized to allow heat to dissipate between operations. Since diffusion occurs only during contact of the PCD surface with the ferrous material, a cyclic operation can especially benefit from the use of PCD tooling.

In one representative application, the ferrous metal is stainless steel, and the method of the present invention includes forming a head suspension for a magnetic disk drive having a longitudinal rail, wherein the step of providing a tool comprises providing a rail punch having the PCD surface for forming rails in the head suspension. Other applications are contemplated in making head suspensions of stainless steel, such as forming dimples using PCD tooling. Moreover, the present invention is applicable in frictional guiding situations, such as assembling suspension base plates and load beams using PCD tooling, where concerns similar to those in forming operations must be addressed.

DETAILED DESCRIPTION OF THE INVENTION

Figure 1:
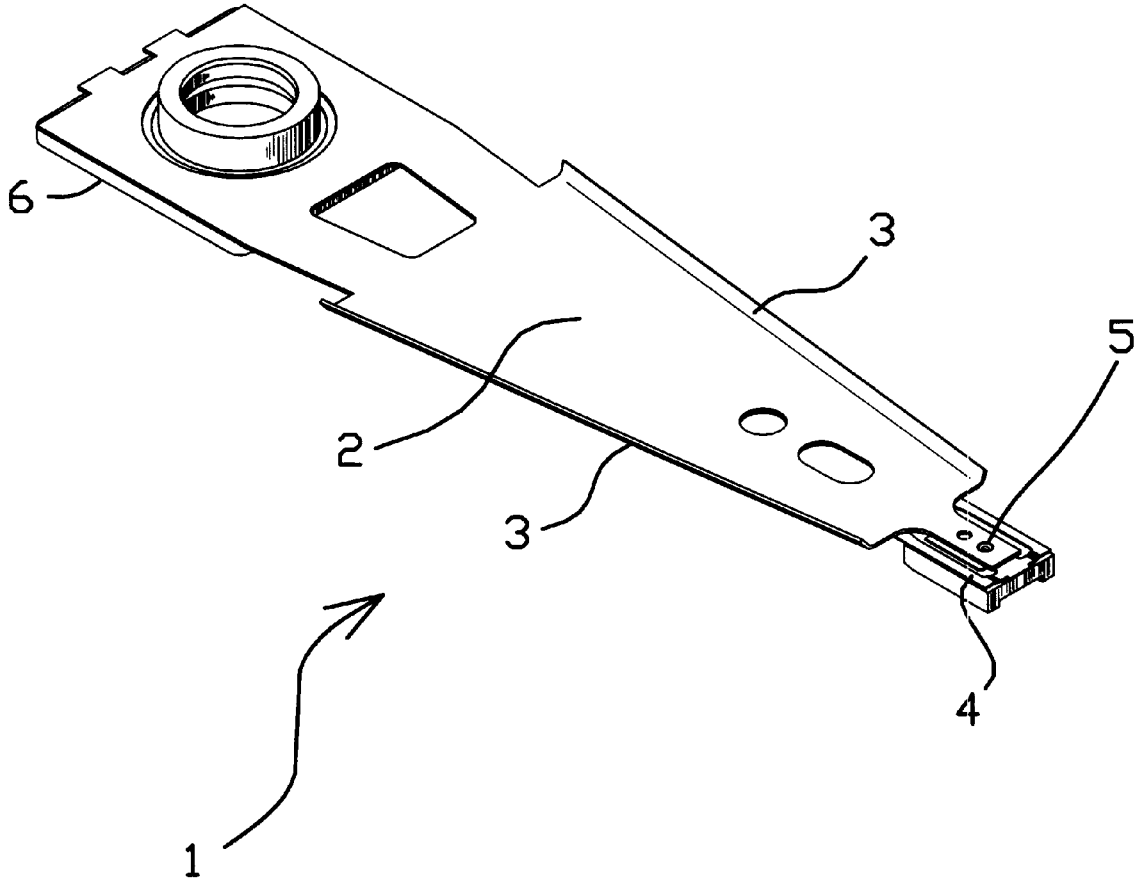
FIG. 1 is an isometric view of a head suspension including side rails and a load point dimple which are formed from the material of the head suspension, and in the forming of which the method of the present invention can be utilized.
Figure 2:
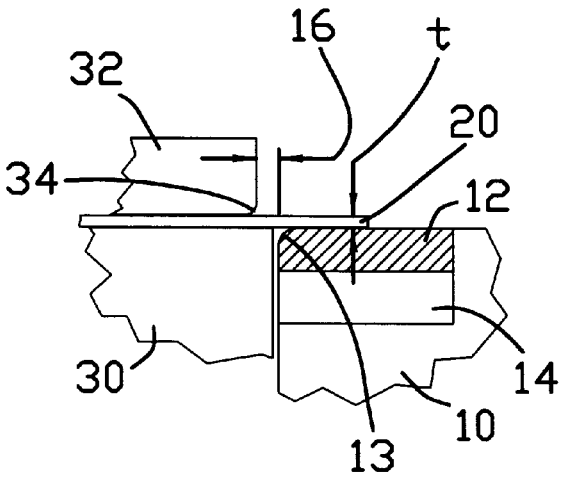
FIG. 2 is a fragmentary side schematic view of a clamping structure and a reciprocating punch with a PCD surface in position just prior to forming a bend in a clamped sheet of ferrous metal, such as, for example, a side rail of a head suspension.

The present invention is directed to a method for forming or guiding an object of ferrous metal with a tool having a polycrystalline diamond (PCD) surface, a plurality of versions of such method schematically illustrated in FIGS. 2–8. FIG. 1 illustrates a head suspension 1 which is typically made of a ferrous metal, preferably stainless steel, which includes parts that can advantageously be formed and guided using tools having PCD surfaces in accordance with the method of the present invention. The method of the present invention was developed in connection with its applicability in making head suspension 1 out of stainless steel; however, the present invention is generally applicable to the forming and guiding of ferrous materials, particularly in sheet form, by tooling having a PCD surface.

For example purposes, a head suspension 1 and the method of the present invention for forming features and frictionally guiding components of a head suspension are briefly described as follows with the understanding that the making of head suspensions is but one application to which the present invention is applicable.

Head suspension 1 is generally comprised of load beam 2, base plate 6 mounted to a proximal end of load beam 2, and a flexure 4 located at a distal end of load beam 2, all of which are well known in the art. Base plate 6 is preferably brought into engagement with and mounted to the proximal end of load beam 6 using a guide tool having an inclined conveyance system with a PCD surface (illustrated in FIGS. 7 and 8 and described in greater detail below). In the illustrated embodiment, the load beam 2 further includes side rails 3 which run substantially longitudinally along head suspension 1 and are formed at the side edges of load beam 2 from the stainless steel sheet from which the load beam 2 is preferably composed. The side rails 3 are preferably formed using a reciprocating rail punch having a PCD surface (illustrated in FIGS. 2–5 and described in greater detail below). The load beam 2 further includes a dimple 5 formed in a flat region of load beam 2 which contacts a movable portion of the flexure 4 and serves as a load point about which flexure 4 gimbals during the normal operation of head suspension 1. Dimple 5 is typically deformed from the stainless steel material of the load beam 2 using a dimple punch and a socket. In accordance with the present invention, the socket is provided with a PCD surface (illustrated in FIG. 6 and described in greater detail below).

FIGS. 2–5 illustrate the use of a reciprocating rail punch 10 having a PCD surface 12 to engage and form a bend in a sheet of ferrous metal 20, such as to form a side rail 18 in a stainless steel sheet for making a load beam, of a head suspension such as that described above and shown in FIG. 1. Ferrous metal sheet 20 is placed between a clamping structure, including a clamp block 30 and form block 32. Form block 32 has a rounded shoulder 34 around which ferrous metal sheet 20 is bent for forming the shape of rail 18. Rail punch 10 includes PCD surface 12, which can be sintered on a conventional tungsten carbide substrate 14. Various grades of PCD can be used in creating PCD surface 12, although a grade of PCD that has a nominal diamond size of less than 1.0 micrometers and that has a relatively high fracture toughness, such as FM series of PCD having a nominal diamond size of 0.3 micrometers and available from Tomei Diamond Corporation of America, is preferably used. Larger grain PCD is conventionally used for machining of non-ferrous materials. Submicron PCD, however, has been found to be advantageous in situations where a smooth surface is required, such as in the operations described herein. That is because submicron PCD is softer than larger grain PCD, and thus is easier to machine, which makes it an ideal substance for complex high tolerance tooling. Smoother surfaces can be attained specifically with wire electrostatic discharge machining. PCD having a nominal diamond size of less than 1.0 micrometers also exhibits higher fracture toughness, with 0.3 micrometer FM series PCD exhibiting the highest fracture toughness of commercially available PCD, and thus is preferably used to reduce chipping or cracking of PCD surface 12. PCD surface 12 and carbide substrate 14 comprise an insert which is preferably brazed to rail punch 10. Other methods of attaching a PCD insert to a tool body, such as soldering or using adhesives, e.g. epoxy, can also be used without departing from the spirit and scope of the present invention. Alternate methods of practicing the invention include using other tools with PCD surfaces provided by known or hereinafter developed methods, such as a rail punch comprised entirely of PCD, a rail punch having a brazed CVD film, or a rail punch with a vapor coated diamond or diamond-like-carbon surface, to engage and form ferrous material. As described in greater detail below, it is one object of the present invention to control the engaging and forming operation, specifically the speeds and forces between the PCD surface and the ferrous metal, so as to limit the amount of heat generated during the forming operation, and thus hold surface temperatures and asperity temperatures (also known as "flash" temperatures caused by the roughness of the surfaces of ferrous metal sheet 20 and rail punch 10) within non-diffusion and non-graphitization ranges for the reasons set out in the Background section.

Figure 3:
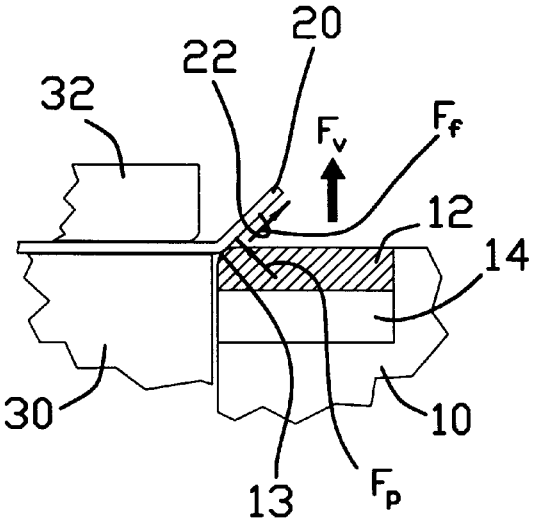
FIG. 3 is a fragmentary side schematic view of the punch of FIG. 2 advanced slightly with its PCD surface beginning the forming operation.
Figure 4:
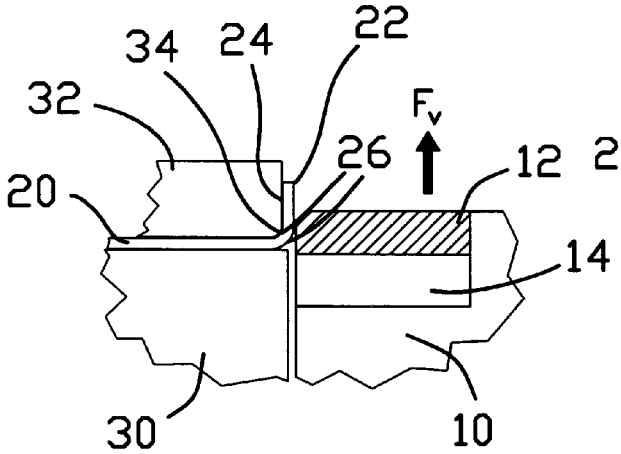
FIG. 4 is a fragmentary side schematic view of the punch further advanced in its forming cycle from the FIG. 3 position with a bend fully formed in the sheet material and the PCD surface at the top of the punch forming stroke.
Figure 5:
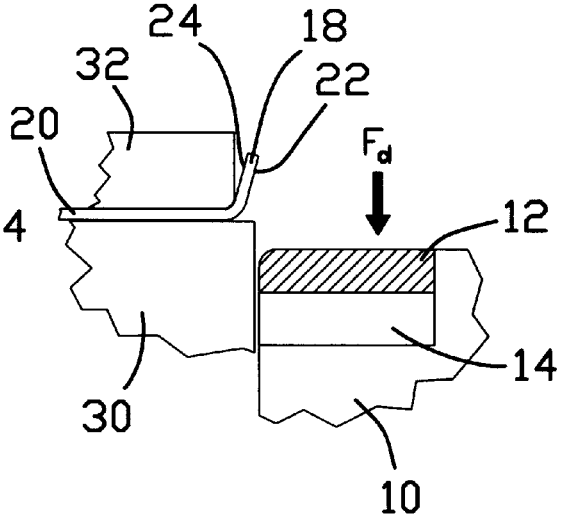
FIG. 5 is a fragmentary side schematic view of the punch further advanced in its cycle than the FIG. 4 position with the bend formed and slightly sprung-back and the PCD surface of the punch at the bottom of the forming stroke.

The general method of forming rail 18 is described as follows. Ferrous metal sheet 20 is positioned between clamp block 30 and form block 32 and frictionally held in place. Rail punch 10 is positioned adjacent to clamp block 30 so that a punch clearance 16, which can be slightly greater than a thickness t of ferrous metal sheet 20, exists between rail punch 10 when fully extended (see FIG. 4) and form block 32. As illustrated in FIG. 3, at the start of the forming stroke, a vertical force $F_v$ is applied to rail punch 10. A rounded shoulder 13 of PCD surface 12 of rail punch 10 engages a first surface 22 of ferrous metal sheet 20, and starts the plastic deformation of ferrous metal sheet 20. At the point of contact, forces $F_p$ and $F_f$ are exerted perpendicular and parallel to first surface 22 of ferrous metal sheet 20, respectively, and comprise the vector components of vertical force $F_v$. Force $F_p$ maintains rail punch 10 in contact with first surface 22 of ferrous metal sheet 20 throughout the forming stroke, and force $F_f$ represents the friction force that exists between PCD surface 12 of rail punch 10 and first surface 22 of ferrous metal sheet 20.

As rail punch 10 advances and continues through the forming stroke, ferrous metal sheet 20 is plastically deformed into a shape coincident with the shape of form block 32. A second surface 24 of ferrous metal sheet 20 confronts rounded corner 34 of form block 32, thus creating rounded comers 26 in the first and second surfaces 22 and 24, respectively, of ferrous metal sheet 20. At the top of the forming stroke, second surface 24 is fully coincident with the shape of form block 32. A vertical force $F_d$ in the opposite direction of force $F_v$ is then applied to rail punch 10 in order to initiate the downward stroke of rail punch 10. Rail punch 10 and first surface 22 of ferrous metal sheet 20 are disengaged, and, due to the metallurgical properties of ferrous metals, particularly stainless steel, ferrous metal sheet 20 further springs back a predetermined amount from form block 32. In this manner, rail 18 is formed.

In the method according to the present invention, this engagement and forming stroke, and repetitive forming strokes, are performed in such a manner so as to limit heat generation and thus surface temperatures of the PCD surface 12 and the surface 22 of the ferrous metal sheet 20. As detailed in the Background section, the iron content of ferrous metal sheet 20 catalyzes the transformation of PCD surface 12 to graphite when rail punch 10 engages ferrous metal sheet 20 at temperatures above about 700 degrees Celsius, thus causing rail punch 10 to wear quickly. Moreover, at temperatures greater than 700 degrees Celsius, the PCD surface 12 of rail punch 10 also rapidly dissolves and diffuses into ferrous metal sheet 20. The method of the present invention, therefore, provides a manner of controlling graphitization, dissolution and diffusion by keeping temperatures of ferrous metal sheet 20 and PCD surface 12 below this 700 degree Celsius threshold.

One method for controlling the above described temperatures is to reduce the overall vertical force $F_v$ used to form rail 18. As detailed above, $F_v$ is comprised of a normal force $F_p$ and a friction force $F_f$. The normal force $F_p$ is dependent upon the geometry and material properties of the ferrous metal sheet 20, but is independent of the material of punch 10 that is used to form rail 18. The normal force $F_p$ is the perpendicular force required with a given moment arm to produce the bending moment and can be determined according to the following equation:

$$F_p=(\sigma^*w^*t^2)/(6^*L)$$

at the outer fiber of the material (i.e., the surface that contacts with punch 10 as spaced from the neutral axis of the material) where:

$\sigma$=the yield stress of the ferrous metal sheet 20;

$w$=the width of the ferrous metal sheet 20;

$t$=the thickness of the ferrous metal sheet 20; and $L$=the length of the moment arm.

Assuming that for stainless steel material, for example, once yield strength is reached, the stress on a fiber of the material will not change significantly as plastic deformation occurs. Thus, yield strength can be used to calculate the forming force required. This implies that the bending moment required for continued plastic deformation at a fiber is constant, but the perpendicular force $F_p$ required may change depending on the moment arm. Since all of the variables in the perpendicular force $F_p$ equation are constant except the length L of the moment arm, which changes as the punch moves and bends the workpiece, the perpendicular forming force $F_p$ will be the largest where the moment arm is the smallest. For a straight wipe punch and form block, this occurs where the center of the form block radius is at the same height as the center of the punch radius.

Since yielding will occur at more than just the outer fiber, the calculated value of $F_p$ is likely an underestimate of the actual force required, since yielding closer to the neutral axis will require more force.

Figure 9:
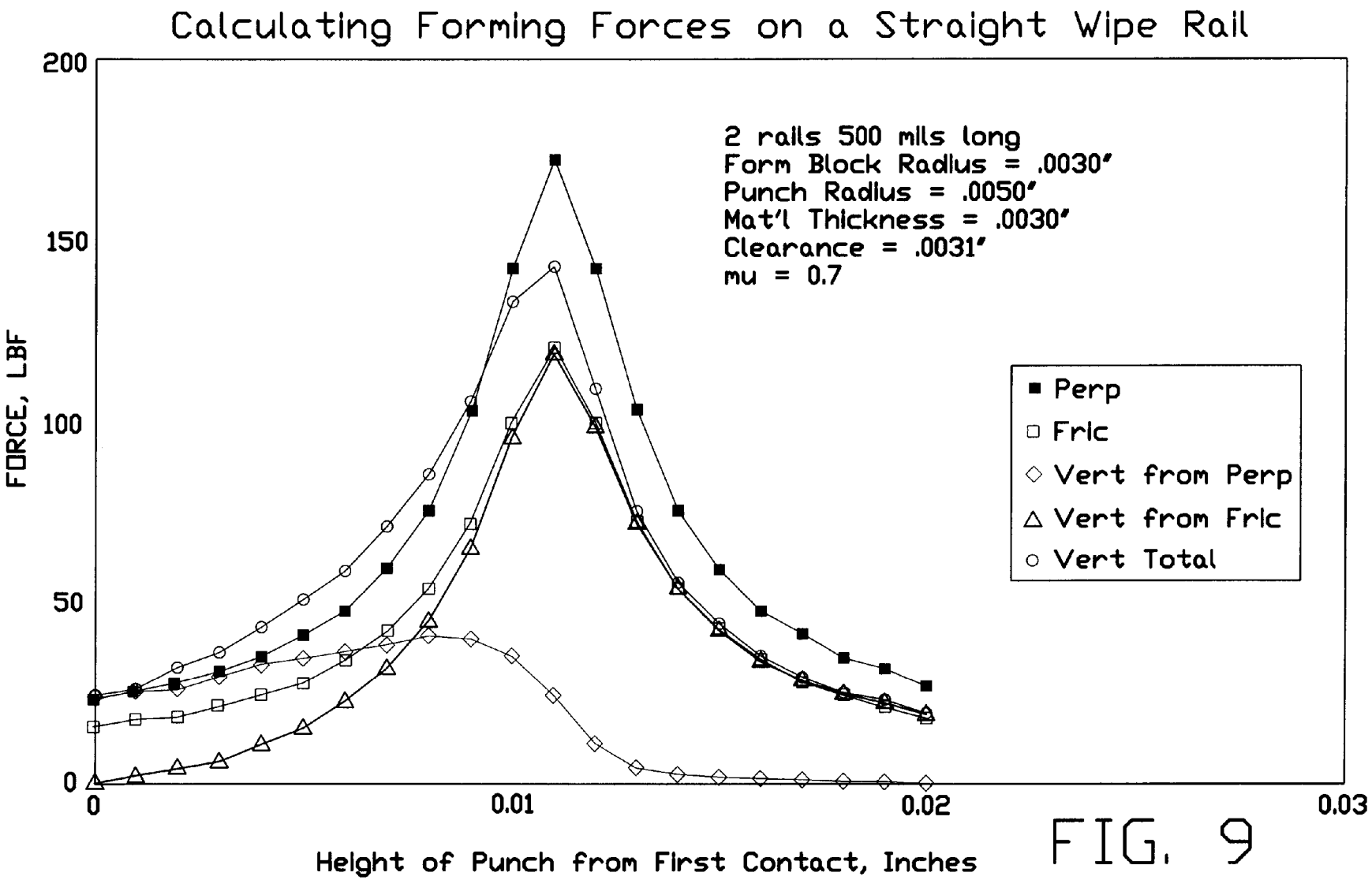
FIG. 9 is a graph of calculated forming forces compared to the movement of a carbide rail punch in the forming of a rail for a head suspension.
Figure 10:
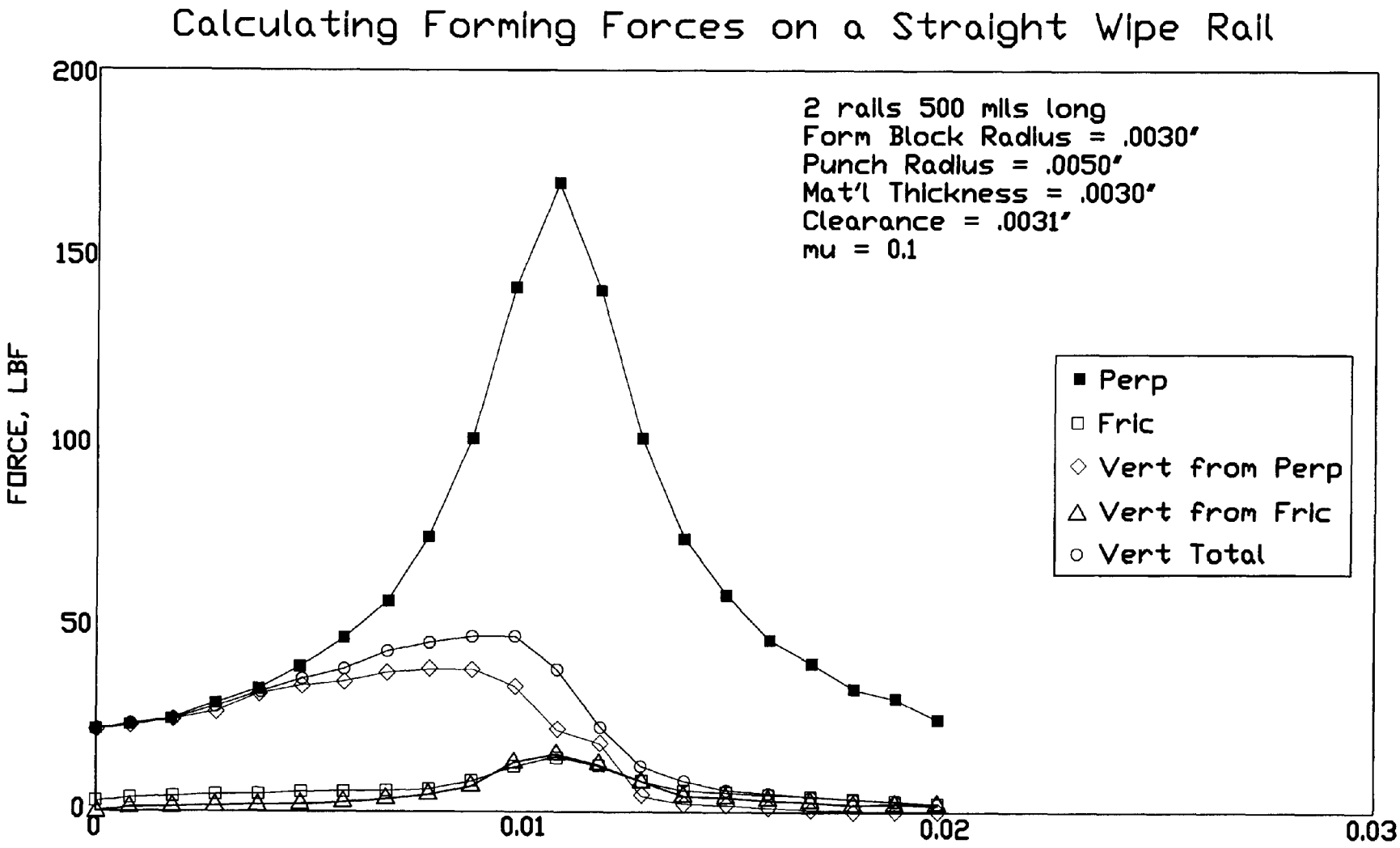
FIG. 10 is a graph of calculated forming forces compared to the movement of a PCD rail punch in the forming of a rail for a head suspension.

The available force for the punch motion is of a vertical nature, and though the perpendicular force is increasing as the punch moves, the vertical component of the perpendicular force decreases as the bend angle increases. If friction is present, the force from friction will be proportional to the perpendicular force, and it will be parallel to the bend angle on the workpiece. Thus the friction force increases as the punch moves to the point of least moment arm, and the vertical component of the friction force increases as the bend angle increases. As can be seen on the graphs of FIGS. 9 and 10, the total vertical force on the punch becomes a maximum at the point of least moment arm when there is high friction, while with low friction, the vertical force may actually start decreasing before the point of least moment arm. FIG. 9 shows the calculated forming forces with a carbide punch. FIG. 10 shows the calculated forming forces with a PCD punch. As evidenced in FIG. 9, the maximum vertical force is obviously much less when there is low friction.

The magnitude of friction force $F_f$ is defined by the equation $$F_f = \mu * F_p$$

where $\mu$=the coefficient of friction between the PCD surface 12 of rail punch 10 and first surface 22 of ferrous metal sheet 20.

Friction force $F_f$ varies based on the material used in rail punch 10 to form rail 18. The coefficient of friction between ferrous metal sheet 20 and rail punch 10 having a PCD surface 12 is about 0.1, while a conventional tungsten carbide cermet punch used to form ferrous metal sheet 20 would result in a coefficient of friction of about 0.7. As such, the friction force $F_f$ will be much lower when forming rail 18 using a rail punch 10 having PCD surface 12. This lower friction force allows a lower overall vertical forming force $F_v$ to be used to form rail 18.

With the ability to reduce the vertical force $F_v$, it is also possible to reduce the acceleration or impact of the punch 10 as it initially engages the ferrous metal sheet 20. Under the basic force equation F=m*a, where m is mass and a is acceleration, a reduced acceleration means less force, which in turn results in less energy that can be converted to heat. A vertical force $F_v$ of about 19 pounds per inch of length of rail 18 can be used to form rail 18 from a ferrous metal sheet 20 which is around 0.003 inches thick. This is significantly less than the 80 pounds per inch of force typically required when using a conventional tungsten carbide cermet rail punch. This lower forming force limits asperity and surface temperatures of ferrous metal sheet 20 and PCD surface 12 to ranges where dissolution and diffusion are negligible. PCD surface temperatures can be limited to about 50 degrees Celsius, and ferrous metal surface and asperity temperatures can be limited to well below 700 degrees Celsius, thus minimizing dissolution and diffusion.

Dissolution, diffusion, and graphitization can also be controlled through the rate at which rail 18 is formed in ferrous metal sheet 20. As the speed between two surfaces in contact with each other increases, the rate of frictional contact per unit time between the surfaces increases, and more heat is generated between the surfaces. The frictional contact comprises the actual point contacts between the surfaces. Energy released by the friction is converted to heat at the asperity contacts between the surfaces. The rate of this energy conversion, and consequently the amount of heat generated, are dependent on the number of frictional contacts per unit time at the interface between PCD surface 12 of rail punch 10 and ferrous metal sheet 20. Slower forming speeds create fewer frictional contacts per unit time. This allows asperities of the interface to cool before the next frictional contact is made. Thus, one manner of controlling heat in accordance with the present invention is to limit the sliding speed during which rail punch 10 and ferrous metal sheet 20 are in contact. The sliding speed is preferably controlled in order to keep the surface and asperity temperatures of the PCD surface 12 and the ferrous metal sheet 20 below the temperatures at which degradation by diffusion or graphitization occur. Preferably, rail punch 10 is operated at a speed of about 2 cm per second in the vertical direction when forming rail 18. This rate, often referred to as the "insert collapse velocity," limits the tool 10 and ferrous metal sheet 20 temperatures to the ranges described above where diffusion is minimized.

Furthermore, heat generation and thus dissolution, diffusion, and graphitization of PCD surface 12 can be limited by controlling the rate of successive forming operations within a cyclic forming operation. Controlling the cycle time between successive forming operations can be advantageously utilized to allow at least some of the heat generated during the forming of rail 18 to dissipate before the next rail is formed. In this manner, the temperature of PCD surface 12 of rail punch 10 can be controlled and limited to ranges described above where dissolution, diffusion, and graphitization of the PCD surface is minimized. Moreover, since diffusion can only occur during contact of the PCD with the ferrous material, a cyclic forming operation benefits more by limiting the contact time.

Furthermore, by reducing the sliding distance during the forming operation, heat generation can be reduced. It has been found that the use of PCD tooling allows shorter distances of punch travel to be used. This can be accomplished by reducing the radius of shoulder 34 of form block 32, which in turn shortens the vertical distance punch 10 must travel to produce the bend in rail 18. The lower sliding distance results in less heat generated.

In accordance with the present invention, any of the above techniques to control and limit heat generation can be used singly or combined with one another. Preferably, the vertical force $F_v$ and thus the impact force are determined and controlled to be minimized. With that, the sliding speed and distance are selected in order to adequately perform the forming operation. Cycle times are then determined taking into account both the time between cycles to permit sufficient heat dissipation and production requirements. By balancing one or more of these factors, heat generation can be limited in accordance with the present invention to permit PCD tooling to be used with ferrous materials.

Figure 6:
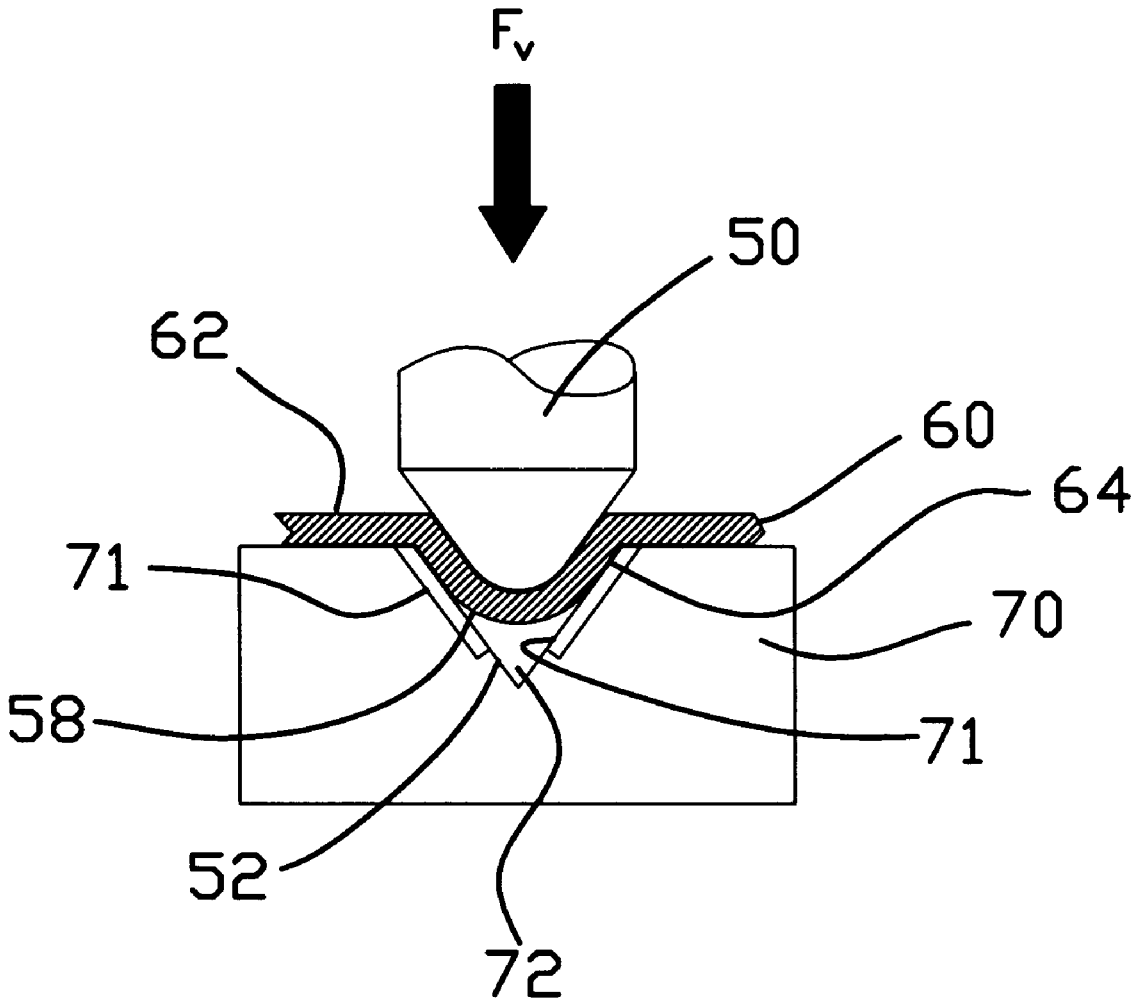
FIG. 6 is a side schematic view of a dimple forming operation including a die supporting a sheet of ferrous material, a dimple punch, and a socket having a PCD surface wherein the dimple punch is shown in its fully advanced position after having formed a dimple in the sheet of ferrous metal.

The present invention is applicable to other friction generating, forming or machining operations that can be controlled in a manner set out above. FIG. 6 illustrates the use of another method in accordance with the present invention for forming a dimple 58 (such as described above and shown in FIG. 1 at 5) in a sheet of ferrous metal 60 in a manner that limits dissolution and diffusion of a PCD surface 71 on a socket 70. Specifically shown in FIG. 6 is a cone shaped dimple which is the subject of copending U.S. patent application Ser. No. 08/673,275, filed Jun. 28, 1996, now abandoned, the disclosure of which is incorporated herein by reference. Similar to the rail punch 10 described above and illustrated in FIGS. 2–5, the PCD surface 71 can be provided to the socket 70 as an insert having the PCD material sintered on to a tungsten carbide substrate (not shown) which is further brazed on to a conventional socket. Otherwise, the entire socket can be formed from PCD, a PCD surface 71 can be vapor coated on a conventional socket 70, or other known or hereinafter developed methods of providing a socket with a PCD surface can be used.

In generally forming dimple 58, ferrous metal sheet 60 is placed on socket 70, which includes a valley 72 for forming the shape of dimple 58. Valley 72 is comprised of walls at least partially having PCD surface 71. A vertical force $F_v$ is applied to a conventional dimple punch 50, causing the dimple punch 50 to engage a first surface 62 of ferrous metal sheet 60. As dimple punch 50 advances and continues its downward stroke, ferrous metal sheet 60 is plastically deformed, and is forced into valley 72 of socket 70. A second surface 64 of ferrous metal sheet 60 contacts PCD surface 71 in valley 72 during the forming stroke. First surface 62 of ferrous metal sheet 60 is formed to be generally coincident with the shape of dimple punch 50 and second surface 64 of ferrous metal sheet 60 is formed to be generally coincident with valley 72, thus forming dimple 58.

During the forming of the dimple 58, relative sliding movement occurs between the second surface 64 of ferrous metal sheet 60 and the PCD surface 71 of the socket 70. The PCD surface 71 preferably extends within the valley 72 sufficiently to provide a PCD surface wherever such sliding contact will occur. As above, the sliding contact generates heat and is to be controlled to limit heat generation below the temperatures of diffusion and graphitization. The control techniques utilized are the same as above. That is, reducing the impact and forming forces, which is facilitated by the use of the PCD material, controlling sliding speed and distance, and controlling cycle times to permit sufficient heat dissipation.

Although the present invention is particularly beneficial for use in forming operations where a significant amount of relative sliding between the ferrous metal and the PCD surface occurs, it is also contemplated that PCD surfaces can be provided where little or no movement occurs. For example, the point of punch 50 can be provided with a PCD surface for engaging first surface 62 of ferrous metal sheet 60 to extend tool life, provided heat generation is limited in accordance with the present invention. Longer tool life of the punch 50 may be expected without degradation.

Figure 7:
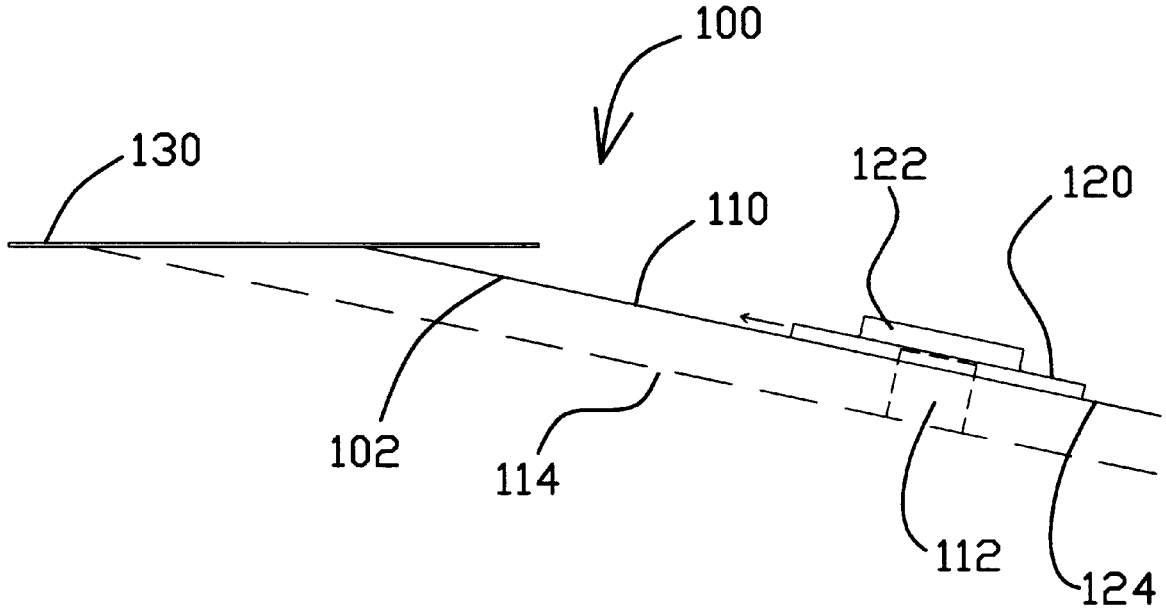
FIG. 7 is a side schematic view of a base plate mounting operation including a guide tool having a PCD surface that engages and guides an object of ferrous metal, such as a base plate, over the PCD surface.
Figure 8:
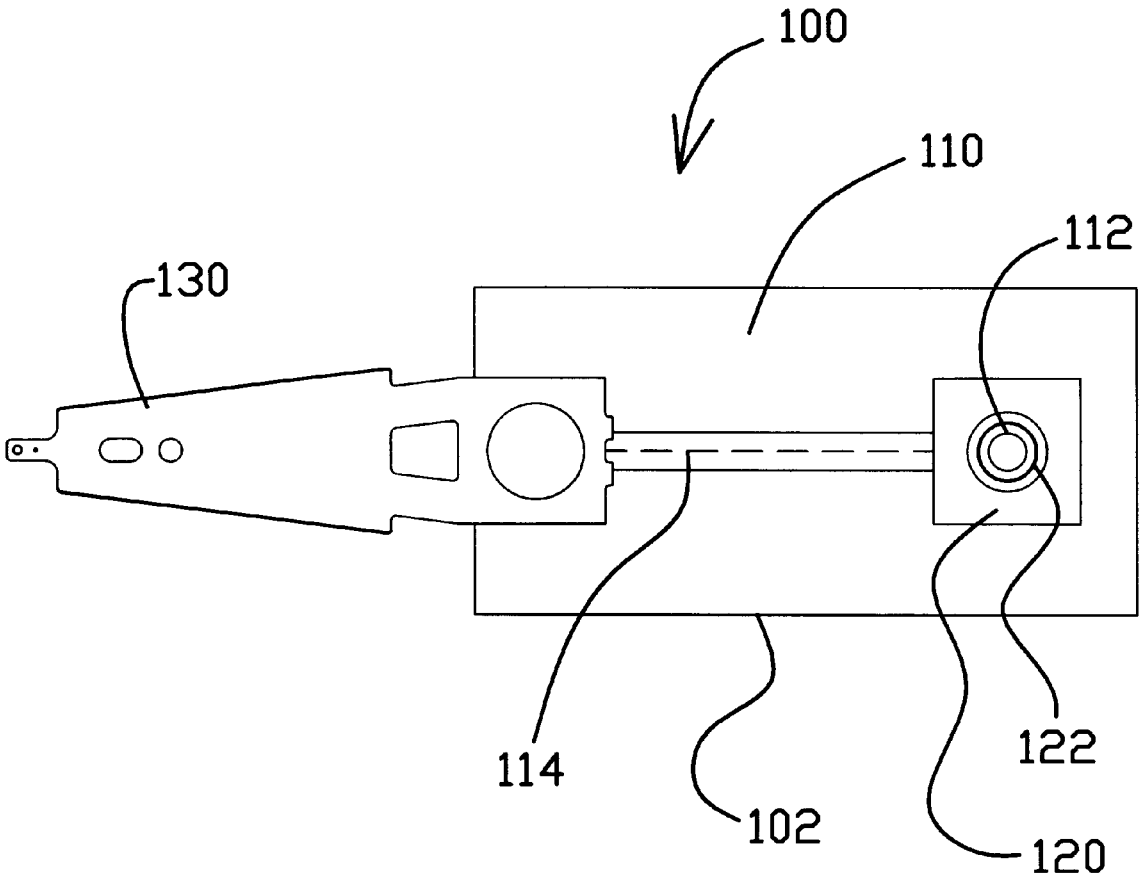
FIG. 8 is a top schematic view of the base plate mounting operation shown in FIG. 7.

FIGS. 7 and 8 illustrate another such application where a tool having a PCD surface can be used to engage ferrous metals. FIGS. 7 and 8 show a guide tool 100 having an inclined member 102 with a PCD surface 110 that is used to engage an object of ferrous metal, such as base plate 120 of a head suspension similar to that shown in FIG. 1. PCD surface 110 can be provided in inclined member 102 as an insert having PCD material sintered on a tungsten carbide substrate (not shown) which is then brazed to a conventional inclined member 102 of a guide tool 100. Other known or hereinafter methods of providing an inclined member with a PCD surface can also be used.

Inclined member 102 is useful in the engagement and mounting of base plate 120 to a head suspension load beam 130. Base plate 120 preferably includes a swaging boss 122. A pin 112 attached to a conveyor 114 of guide tool 100 engages swaging boss 122 and brings a lower surface 124 of base plate 120 into contact with PCD surface 110. The conveyor 114 and pin 112 move base plate 120 up inclined member 102 and over PCD surface 110, and bring base plate 120 into contact with load beam 130. Conventional means such as welding or adhesive can then be used to mount base plate 120 to load beam 130.

During this friction generating operation, the initial contact and relative sliding motion between PCD surface 110 and lower surface 124 of base plate 120 will generate heat. As with the applications described above, the contact between base plate 120 and PCD surface 110 is controlled to limit this heat generation to levels below temperatures that cause diffusion and graphitization. Specifically, the surface temperatures of PCD surface 110 and base plate 120 can be limited to below 50 degrees Celsius and below 700 degrees Celsius, respectively. The control techniques utilized are the same as described above in connection with the rail and dimple forming operations, including limiting the initial impact force between base plate 120 and PCD surface 110, and limiting the acceleration and friction between the ferrous material and PCD surface.

As described in the Background section, the use of tools to form and frictionally guide ferrous metal provides significant advantages over the use of conventional tools having tungsten carbide cermet or tool steel surfaces. Tools having PCD surfaces are subject to less erosion with usage and enjoy a longer useful life due to the increased hardness of the PCD surface, with the useful life of tools having a PCD surface being extended by at least 10 times, and often 50 to 200 times, the useful life of conventional tools having a tungsten carbide or tool steel surface. In addition, PCD surfaces are generally smoother than conventional tool surfaces, thus providing a smoother finished surface that requires little or no finishing work. Moreover, due to the reduced surface energy of PCD, ferrous material build-up on the tool surface is significantly reduced. However, it has been found that slight ferrous material build-up is beneficial in that it helps to keep the tool surface smooth and helps to extend the useful life of the tool, because ferrous material only accumulates in the valleys of the PCD surface of the tool, which correspondingly reduces the overall abrasive capability of the tool surface over time. The reduced material build-up thus not only increases the useful life of the tool, it actually improves the quality of the finished workpiece that is engaged or formed by the PCD surface.

Although the present invention has been described with reference to preferred embodiments, those skilled in the art will recognize that changes may be made in form and detail without departing from the spirit and scope of the invention.

What is claimed is:

1. A method for forming ferrous metal which comprises:

providing a tool having a polycrystalline diamond surface;

providing a sheet of ferrous metal; and engaging the polycrystalline diamond surface of the tool with the sheet of ferrous metal, advancing the tool and thereby plastically deforming the ferrous metal while controlling the impact of the tool and the advancing of the tool in the deforming operation so that insufficient heat is generated by the deformation at the surface of the sheet of ferrous metal to cause significant degradation of the polycrystalline diamond surface of the tool by diffusion thereof in the ferrous metal, the impact of the tool and the advancing of the tool being controlled to limit the surface temperature of the sheet of ferrous metal to about less than 700 degrees Celsius.

2. The method of claim 1 wherein the step of providing a sheet of ferrous metal comprises providing a sheet of stainless steel.

3. The method of claim 1 wherein the method comprises forming a load beam of a head suspension.

4. The method of claim 3, further including forming a rail within a surface of the load beam and said step of providing a tool comprises providing a rail punch having the polycrystalline diamond surface for forming the rail in the load beam during said advancing step.

5. The method of claim 1 wherein the step of engaging the tool and the sheet of ferrous metal to plastically deform the ferrous metal under conditions which limit diffusion of the polycrystalline diamond surface of the tool includes limiting the surface temperature of the polycrystalline diamond surface of the tool to about less than 50 degrees Celsius.

6. A method for engaging ferrous metal which comprises:

providing a tool having a polycrystalline diamond surface;

providing an object of ferrous metal;

engaging the polycrystalline diamond surface of the tool with a surface of the object of ferrous metal; and relatively moving the polycrystalline diamond surface and the object surface while controlling the impact and relative movement between the tool and ferrous metal so that insufficient heat is generated by the engagement of the tool and the ferrous metal to cause significant degradation of the polycrystalline diamond surface of the tool by diffusion thereof in the ferrous metal, the impact and relative movement between the tool and the object of ferrous metal being controlled to limit the surface temperature of the object of ferrous metal to about less than 700 degrees Celsius.

7. The method of claim 6 wherein the step of providing an object of ferrous metal comprises providing an object of stainless steel.

8. The method of claim 6 wherein the step of moving the tool and the object of ferrous metal under conditions which limit diffusion of the polycrystalline diamond surface of the tool includes limiting the surface temperature of the tool to about 50 degrees Celsius.

* * * * *